US007553124B1

(12) United States Patent
Jimenez

(10) Patent No.: US 7,553,124 B1
(45) Date of Patent: Jun. 30, 2009

(54) PUMP FOR PUMPING HIGH-VISCOSITY LIQUIDS, SLURRIES, AND LIQUIDS WITH SOLIDS

(76) Inventor: Juan Jimenez, 11310 Hylander Dr., Houston, TX (US) 77070

( * ) Notice: Subject to any disclaimer, the term of this patent is extended or adjusted under 35 U.S.C. 154(b) by 353 days.

(21) Appl. No.: 11/487,028

(22) Filed: Jul. 17, 2006

(51) Int. Cl.
*F01D 3/02* (2006.01)
*F01D 13/02* (2006.01)

(52) U.S. Cl. ..... 415/99; 415/90; 415/101; 415/102; 415/131; 415/143

(58) Field of Classification Search ..... 415/90, 415/99, 101, 102, 131, 143
See application file for complete search history.

(56) References Cited

U.S. PATENT DOCUMENTS 1,406,297 A * 2/1922 Stewart ..... 415/130
3,901,623 A * 8/1975 Grennan ..... 415/141
4,135,852 A 1/1979 Archibald
4,439,200 A 3/1984 Meyer et al.
4,662,819 A * 5/1987 Lakowske et al. ..... 415/129
5,800,058 A * 9/1998 Cook ..... 366/306
6,074,167 A * 6/2000 Olifirov et al. ..... 415/131
6,315,532 B1 11/2001 Appleby

* cited by examiner

*Primary Examiner*—Igor Kershteyn
(74) *Attorney, Agent, or Firm*—Egbert Law Offices PLLC

(57) ABSTRACT

The present invention is a centrifugal pump that pumps high-viscosity liquids, slurries, and solids-containing liquids. The pump has a housing, a chamber formed within the housing, a first discoidal member positioned in the chamber, a second discoidal member positioned in that chamber, connecting rods connecting a periphery of the first discoidal member to a periphery of the second discoidal member, and a drive for rotating the first discoidal member and the second discoidal member positioned in the chamber. The first discoidal member is either a recessed impeller or half-regular closed centrifugal impeller. The second discoidal member is a recessed impeller, a disc impeller, or a half-regular closed centrifugal impeller. The second discoidal member has a hole in the center.

14 Claims, 3 Drawing Sheets

PUMP FOR PUMPING HIGH-VISCOSITY LIQUIDS, SLURRIES, AND LIQUIDS WITH SOLIDS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to an apparatus for pumping high-viscosity liquids, slurries and liquids with solids. More particularly, the present invention combines discoidal members of a centrifugal pump located in the pump housing so as to create a centrifugal pump that has better efficiency and lower maintenance cost than current pumps while pumping high-viscosity liquids, slurries and liquids with solids.

BACKGROUND OF THE INVENTION

This invention relates generally to pumps for the handling of high viscosity liquids, slurries, and liquids with solids, collectively referred to as high-viscosity fluids (HVFs). Centrifugal pumps may be used for pumping HVFs; however, traditional centrifugal pumps have problems with cavitation, clogging, binding, and high wear when used with HVFs. This is due to the intrinsic nature of a typical centrifugal pump in which the impeller has vanes which are designed to shear and sling a liquid in order to impart a centrifugal force thereon.

To meet the shortcomings of traditional centrifugal pumps in pumping HVFs, those knowledgeable in the art have utilized various alternative types of pumps, including: progressive cavity pumps, screw pumps, gear pumps, lobe pumps, diaphragm pumps, and piston pumps. These pumps are used because they can have higher flow rates, outlet pressure, and efficiency than traditional centrifugal pumps; however, these alternative pumps are much more costly to maintain than centrifugal pumps. Further, these alternative pumps are more likely to degrade the quality of the fluid they pump because they are in direct contact with the HVFs and have tight tolerances.

Centrifugal pumps have been modified to meet the shortcomings of these alternative pumps in pumping HVFs. Such modifications include centrifugal pumps that use specially designed impellers. The more radical of these designs has completely done away with the vanes of a typical impeller. Some centrifugal pumps have been modified to create a vortex to help with pumping HVFs. These are known as recessed impeller pumps. Both of these designs are highly inefficient because they both have considerable slippage and dead zones.

Centrifugal pumps with disc impellers, despite being pumps that pump HVFs, are known to be highly inefficient because of dead zones. Disc impellers are impellers shaped like a disc that rotate in the fluid so as to impart motion on the fluid. Disc impeller can be provided with vanes or channels for imparting the necessary centrifugal force on HVFs. Alternatively, a disc impeller can be provided with no channels or vanes. Regardless of the existence of vanes on the disc impeller, dead zones are created at a certain distance away from the disc and slippage occurs at the surface of the disc. This is because disc pumps rely on boundary layer theory as the pumping mechanism, which means that HVFs are pumped by the movement created by friction between the surface of the disc and the HVFs. HVF speed is greatest next to the boundary where the surface of the disc meets the HVF. HVF speed decreases the further away it is from the disc surface until it reaches a distance where the HVF is stagnant. This is known as the dead zone, and dead zones create significant barriers to pumping efficiency in disc pumps.

Centrifugal pumps with disc impellers are also known to be highly inefficient because of slippage. The boundary layer theory explains why disc pumps are used with HVFs as opposed to low-viscosity fluids. The more viscous a HVF, the more likely it is to create friction with the surface of the disc. It is this friction that imparts motion on the fluid, so a fluid that is non-viscous would never pump because the friction at the disc boundary is too low to cause movement. Disc impellers do create enough friction to move HVFs, but nonetheless, slippage still exists for HVFs, and efficiency is sacrificed.

Vortex impellers, called "recessed impellers" because of their special design for pumping, also have slippage and dead zone problems. A recessed impeller's vanes are retracted compared to a typical impeller, with the front of the impeller being the small part of the cone and the back of the impeller being the larger part of the cone. This design creates a tornado effect through which torque is imparted unto the HVF by only contacting a portion of the HVF. As in disc pumps, dead zones exist at a distance away from the surface of the impeller (usually on the periphery of the housing near the inlet), but vortex pumps also have a dead zone at the tip of the recessed impeller. While the efficiency of vortex pumps is better than disc or dual disc pumps, it is still much lower than the alternative pump designs mentioned above.

U.S. Pat. No. 4,439,200, issued on Mar. 27, 1984 to Meyer et al., discloses a centrifugal pump utilizing a disc impeller with channels. This pump employs an impeller in the shape of a disc which acts directly upon the material to impart the necessary rotary motion. With this particular disc, centrifugal force is imparted on HVFs by radially extending channels on the surface of the disc. The HVFs flow through the channels to attain the desired rotary motion.

U.S. Pat. No. 6,315,532, issued on Nov. 13, 2001 to Appleby, discloses a centrifugal pump for pumping HVFs that has two disc impellers instead of just one. Both discs rotate so as to impart centrifugal force on HVFs. Efficiency of a dual disc design is improved over that of a single disc, but it is still relatively low because of the inherent nature of disc pumps. As discussed above, HVF speed in disc pumps is greatest at the boundary where the surface of the disc meets the HVF, and speed decreases as the HVF moves away from the surface, creating dead zones. Dual disc pumps reduce the size of the dead zone in disc pumps, but dead zones are not eradicated. Additionally, the dual disc design also has slippage just as the single disc design. Thus, efficiency is still a problem in dual disc pumps because of slippage and dead zones located between the disc impellers where there is no HVF movement.

U.S. Pat. No. 4,135,852, issued on Jan. 23, 1979 to W. Archibald, provides a centrifugal pump utilizing an impeller with vanes that creates a vortex to pump HVFs. In other words, the impeller only acts upon a small portion of the HVF passing through the pump vortex chamber and induces centrifugal forces within a vortex chamber so as to induce vortical movement of the HVFs.

Despite these modifications, these improved centrifugal pump designs are still highly inefficient because of considerable slippage and the existence of dead zones.

It is an object of this invention to provide a centrifugal pump for pumping HVFs.

It is a further object of this invention to provide a centrifugal pump that minimizes slippage and dead zones typically found in centrifugal pumps that pump HVFs.

It is still a further object of this invention to minimize the wear increase the efficiency of centrifugal pumps when pumping HVFs.

It is still a further object of this invention to couple a recessed impeller or half-regular closed impeller with another recessed impeller, half-regular closed impeller, or disc impeller so as to pump HVFs.

These and other objects and advantages of the present invention will become apparent from a reading of the attached specification and appended claims.

BRIEF SUMMARY OF THE INVENTION

The present invention utilizes various pump configurations so as to minimize slippage and dead zones in a centrifugal pump when pumping high-viscosity liquids, slurries, and solids-containing liquids.

A first embodiment of the present invention has a recessed impeller design connected to a disc. The disc has a hole in the center allowing for the HVF to pass through and is connected to the recessed impeller via adjustable rods. The rods, for example, can have a thickness of three-eighths of an inch. In the preferred embodiment of the present invention, adjusting the rods can vary the distance between the recessed impeller and disc to suit the nature of the HVF.

A second embodiment of the present invention has two recessed impellers that face each other and are connected via adjustable rods. The front recessed impeller has a hole in the center allowing for HVF to pass through. The rods, for example, can be ⅜" thick and allow for the space between the impellers to be adjusted to suit the nature of the HVF.

A third embodiment of the present invention has a regular closed impeller cut in half along the vanes between the front and rear shroud. The two halves are then connected via adjustable rods so that the gap between the halves can be varied to suit the nature of the HVF. The rods, for example, can be ⅜" thick and allow for the space between the impellers to be adjusted to suit the nature of the HVF.

DETAILED DESCRIPTION OF THE INVENTION

Figure 1:
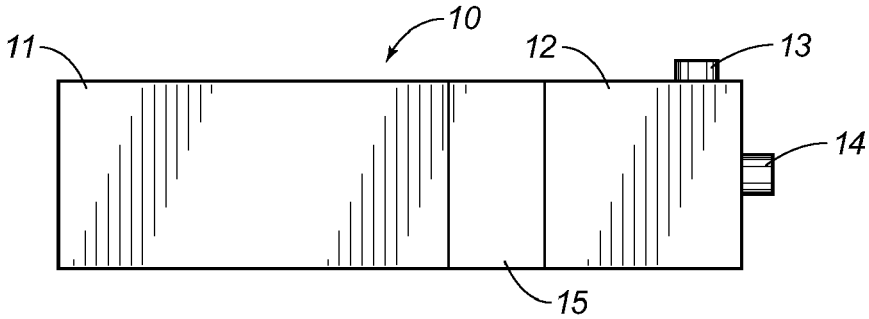
FIG. 1 Prior Art
FIG. 1 is a diagrammatic illustration of a centrifugal pump of the prior art.

Referring to FIG. 1, there is shown a simplified diagram of a prior art centrifugal pump 10. The pump 10 has a motor 11, a housing 12, and a drive means 15 connecting the motor 11 to the housing 12. The housing has an inlet 14 and an outlet 13. A typical housing 12 has a chamber therein with corresponding inlets and outlets (shown in FIGS. 2 and 3). Discoidal members (shown in subsequent figures) which pump the HVF entering the housing 12 at inlet 14 are found within the chamber formed within the housing 12.

Figure 2:
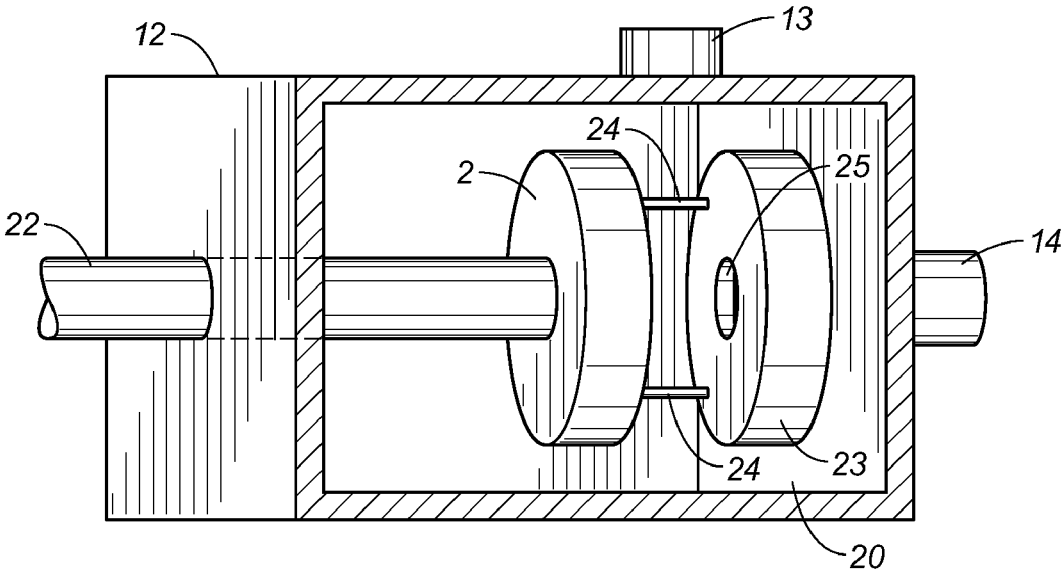
FIG. 2 Prior Art
FIG. 2 is a perspective cut-away view of the housing and the chamber of the prior art centrifugal pump with disc impellers for pumping HVFs.

Referring to FIG. 2, there is shown a cut-away view of one embodiment of a prior art centrifugal pump housing 12. A chamber 20 is formed within the housing 12. The inlet 14 allows HVF to enter the chamber 20 where the HVF is mechanically excited and pumped out of the outlet 13 by disc impeller 21 and disc impeller 23. Typically, disc impeller 23 is connected to disc impeller 21 via connecting rods 24. Disc impeller 23 has a hole 25 in its center so as to allow HVF to flow therethrough. Disc impeller 21 is connected to the motor 11 by means of a drive shaft 22. The drive shaft 22 transfers the energy of rotation from the motor 11 to the impeller 21, which then excites HVF in the chamber 20 so as to pump the HVF out of the chamber 20 through the outlet 13.

Figure 3:
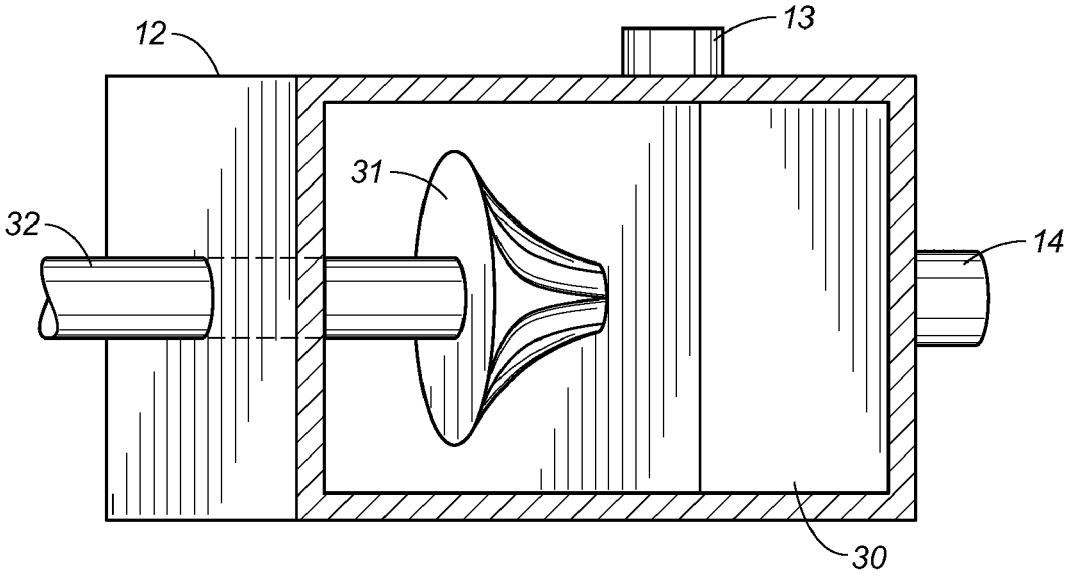
FIG. 3 Prior Art
FIG. 3 is a perspective cut-away view of the housing and the chamber of the prior art centrifugal pump with a recessed impeller for pumping HVFs.

Referring to FIG. 3, there is shown a cut-away view of another embodiment of a prior art centrifugal pump housing 12. A chamber 30 is formed within the housing 12. The inlet 14 allows HVF to enter the chamber 30 where the HVF is mechanically excited and pumped out of the outlet 13 by an impeller 31. Typically, the impeller 31 is connected to the motor 11 by means of a drive shaft 32. The drive shaft 32 transfers the energy of rotation from the motor 11 to the impeller 31, which then excites HVF in the chamber 30 so as to pump the HVF out of the chamber 30 through the outlet 13.

Figure 4:
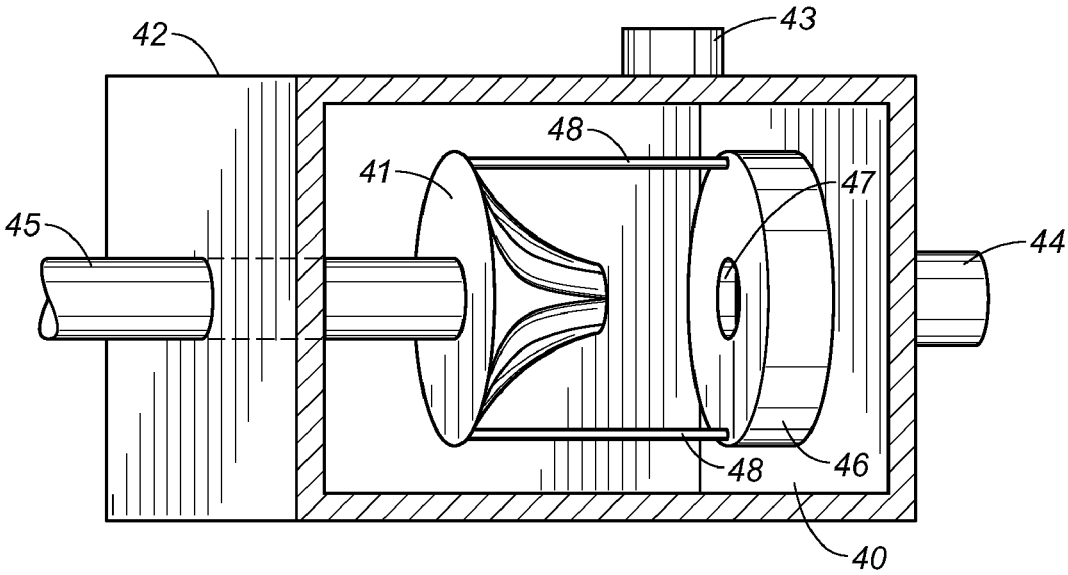
FIG. 4 is a perspective cut-away view of the present invention showing a housing and a chamber with a recessed impeller in combination with a disc for pumping HVFs.

FIG. 4 shows a cut-away view of a first embodiment of the housing of the present invention. The housing 42 has a chamber 40 with inlet 44 and outlet 43. The present invention utilizes an impeller 41 driven by a drive shaft 45. The impeller 41 is a recessed impeller which is connected via ⅜" rods 48 to a disc impeller 46. The disc impeller 46 has a hole 47 in the center so as to allow HVF to flow therethrough. The recessed impeller 41 and disc impeller 46 together rotate so as to pump HVF out of the chamber 40 through the outlet 43.

Figure 5:
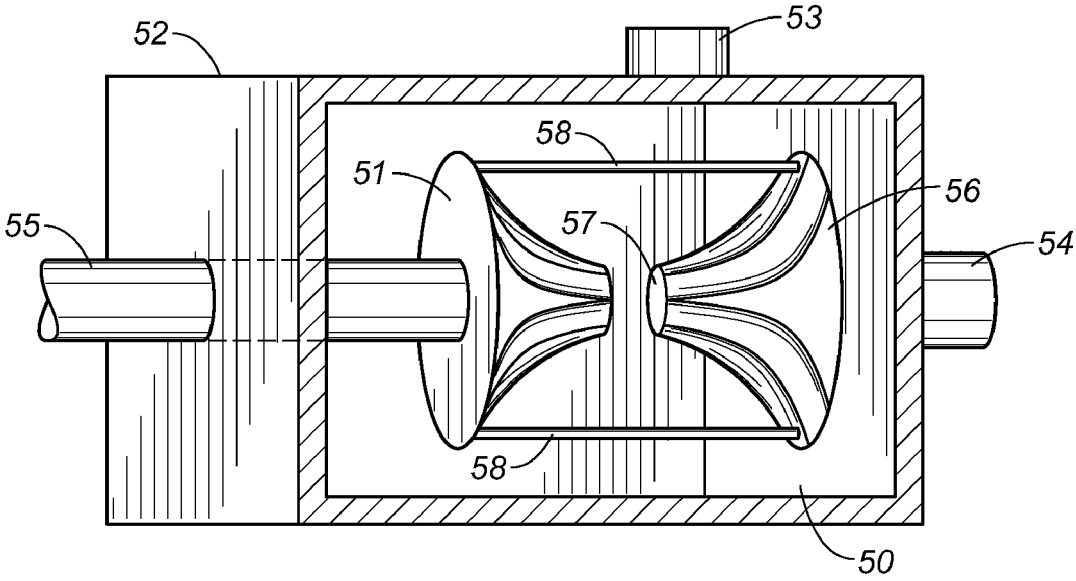
FIG. 5 is a perspective cut-away view of an alternative embodiment of the present invention showing the housing and the chamber with two recessed impellers facing each other for pumping HVFs.

FIG. 5 shows a cut-away view of a second embodiment of the housing of the present invention. The housing 52 has a chamber 50 with inlet 54 and outlet 53. The present invention utilizes an impeller 51 driven by a drive shaft 55. The impeller 51 is a recessed impeller which is connected via ⅜" rods 58 to a second impeller 56. The second impeller 56 is also a recessed impeller. The two impellers 51 and 56 face each other. The second impeller 56 also has a hole 57 in the center so as to allow HVF to flow therethrough. The recessed impeller 51 and recessed impeller 56 together rotate so as to pump HVF entering the inlet 54 out of the chamber 50 through the outlet 53.

Figure 6:
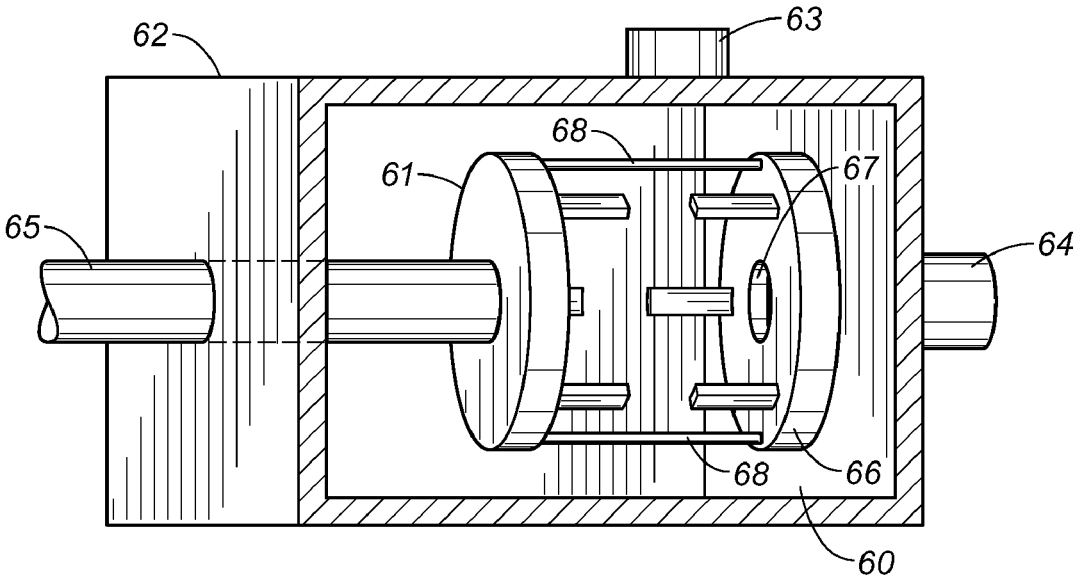
FIG. 6 is a perspective cut-away view of another alternative embodiment of the present invention showing the housing and the chamber with two half-regular closed impellers for pumping HVFs.

FIG. 6 shows a cut-away view of a third embodiment of the housing of the present invention. The housing 62 has a chamber 60 with inlet 64 and outlet 63. The present invention utilizes an impeller 61 driven by a drive shaft 65. The impeller 61 is a half-regular closed impeller which is connected via ⅜" rods 68 to another half regular closed impeller 66. Both impeller 61 and impeller 66 have vanes 69. Impeller 61 and impeller 66 face each other. Impeller 66 also has a hole 67 in the center so as to allow HVF to flow therethrough. Impeller 61 and impeller 66 together rotate so as to pump HVF entering the inlet 64 out of the chamber 60 through the outlet 63.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A pump for pumping high-viscosity liquids, slurries, and solids-containing liquids, the pump comprising:

a housing;

a chamber formed within said housing;

a first discoidal member positioned within said chamber, said first discoidal member being a first recessed impeller;

a second discoidal member positioned within said chamber, said second discoidal member being a second recessed impeller;

a means for connecting said first discoidal member and said second discoidal member; and a drive means cooperative with said housing for rotating said first discoidal member and said second discoidal member.

2. The pump of claim 1, wherein said chamber has an inlet and an outlet.

3. The pump of claim 1, wherein said means for connecting said first discoidal member and said second discoidal member comprises a plurality of adjustable rods connected to a periphery of said first discoidal member and to a periphery of said second discoidal member.

4. The pump of claim 3, wherein said first and second recessed impellers face each other.

5. A pump for pumping high-viscosity liquids, slurries, and solids-containing liquids, the pump comprising:

a housing;

a chamber formed within said housing;

a first discoidal member positioned within said chamber;

a second discoidal member positioned within said chamber;

a means for connecting said first discoidal member and said second discoidal member; and a drive means cooperative with said housing for rotating said first discoidal member and said second discoidal member, said chamber having an inlet and an outlet, said first discoidal member being a half-regular closed centrifugal impeller.

6. The pump of claim 5, wherein said second discoidal member is a half-regular closed centrifugal impeller.

7. The pump of claim 5, wherein said means for connecting said first discoidal member and said second discoidal member comprises a plurality of adjustable rods connected to a periphery of said first discoidal member and to a periphery of said second discoidal member.

8. A pump for pumping high-viscosity liquids, slurries, and solids-containing liquids, the pump comprising:

a housing;

a chamber formed within said housing;

a first discoidal member positioned in said chamber, said first discoidal member being a recessed impeller;

a second discoidal member positioned in said chamber, said second discoidal member being a recessed impeller;

a means for connecting said first discoidal member and said second discoidal member; and a drive means cooperative with said housing for rotating said first discoidal member and said second discoidal member.

9. The pump of claim 8, wherein said first discoidal member faces said second discoidal member.

10. The pump of claim 9, wherein said chamber has an inlet and an outlet.

11. The pump of claim 10, wherein said means for connecting said first discoidal member and said second discoidal member comprises a plurality of adjustable rods connected to a periphery of said first discoidal member and to a periphery of said second discoidal member.

12. A pump for pumping high-viscosity liquids, slurries, and solids-containing liquids, the pump comprising:

a housing;

a chamber formed within said housing;

a first discoidal member positioned in said chamber, said first discoidal member being a half-regular closed centrifugal impeller;

a second discoidal member positioned within said chamber, said second discoidal member being a half-regular closed centrifugal impeller;

a means for connecting said first discoidal member and said second discoidal member; and a drive means cooperative with said housing for rotating said first discoidal member and said second discoidal member.

13. The pump of claim 12, wherein said chamber has an inlet and an outlet.

14. The pump of claim 13, wherein said means for connecting said first discoidal member and said second discoidal member comprises a plurality of adjustable rods connected to a periphery of said first discoidal member and to a periphery of said second discoidal member.

* * * * *